US005749719A

United States Patent [19]

Rajewski

[11] Patent Number: 5,749,719

[45] Date of Patent: May 12, 1998

[54] VELOCITY SEALED FLARE TIP

[76] Inventor: Robert Karl Rajewski, R.R. #1, Donalda, Alberta, Canada, T0B 1H0

[21] Appl. No.: 736,944

[22] Filed: Oct. 25, 1996

[51] Int. Cl.[6] ..... F23D 5/00

[52] U.S. Cl. ..... 431/202; 431/4; 431/5; 431/114; 431/190

[58] Field of Search ..... 431/202, 4, 5, 431/114, 190

[56] References Cited

U.S. PATENT DOCUMENTS

| | | | |
|---|---|---|---|
| 4,092,908 | 6/1978 | Straitz, III | 98/60 |
| 4,269,583 | 5/1981 | Straitz, III | 431/202 |
| 4,643,669 | 2/1987 | Bozai | 431/114 X |

FOREIGN PATENT DOCUMENTS

| | | | |
|---|---|---|---|
| 781249 | 3/1968 | Canada | 158/82 |
| 1089662 | 11/1980 | Canada | 67/37 |

OTHER PUBLICATIONS

Drawing of Prior Art, undated.

*Primary Examiner*—Larry Jones

[57] ABSTRACT

A flare stack with increased flow velocity of gases. The flare stack includes a pipe having a flare tip. The flare tip has a top edge. A conical shield having an apical end and a base is secured to and spaced from the flare tip to allow gas to flow between the conical shield and the flare tip. The conical shield is open at the apical end adjacent the top edge of the flare tip. A source of forced gas, preferably air, provides a flow of gas between the conical shield and the flare tip. Preferably, the base of the conical shield is closed.

5 Claims, 1 Drawing Sheet

VELOCITY SEALED FLARE TIP

FIELD OF THE INVENTION

This invention relates to devices used for the flaring of gas.

CLAIM TO COPYRIGHT

Not applicable

CROSS-REFERENCE TO OTHER APPLICATIONS

Not applicable

REFERENCE TO MICROFICHE APPENDIX

Not applicable

BACKGROUND OF THE INVENTION

It is frequently necessary to burn gas at oil and gas installations. The gas is typically directed to a vertically standing pipe or flare stack. Gas exiting the top of the pipe is ignited with an ignitor. It is important that the gas be kept burning. With high winds, the flame can easily be blown out. As a result, high gas flow rates may be required to keep the flame alive.

In one prior art flare tip, a conical shield is welded to the flare tip without a passage for the flow of gas between them. The conical shield helps to deflect cross-winds and prevent them from entering the flare tip. Thus, purge gas flow rates can be reduced somewhat.

In another prior art flare tip, gas is dispersed through a spreader at the top of the flare tip. The spreader may have the form of tubes extending horizontally and radially outward from the top of the flare tip. Holes in the upper edge of the tubes vent gas upward. A concentric pipe disposed around the tubes forms an annulus through which air is blown past the tubes. The added air and the spreading of the gas with the spreader helps to prevent downdrafts from blowing out the flame at the flare tip.

The inventor has found that the performance of flare tips in terms of wastage of purge gas and flare tip life may be improved by use of the invention described in the following.

SUMMARY OF THE INVENTION

In accordance with a broad aspect of the invention, there is provided a flare stack with increased flow velocity of gases. The flare stack includes a pipe having a flare tip. The flare tip has a top edge. A conical shield having an apical end and a base is secured to and spaced from the flare tip to allow gas to flow between the conical shield and the flare tip. The conical shield is open at the apical end adjacent the top edge of the flare tip. A source of forced gas, preferably air, provides a flow of gas between the conical shield and the flare tip. Preferably, the base of the conical shield is closed.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

Figure 1:
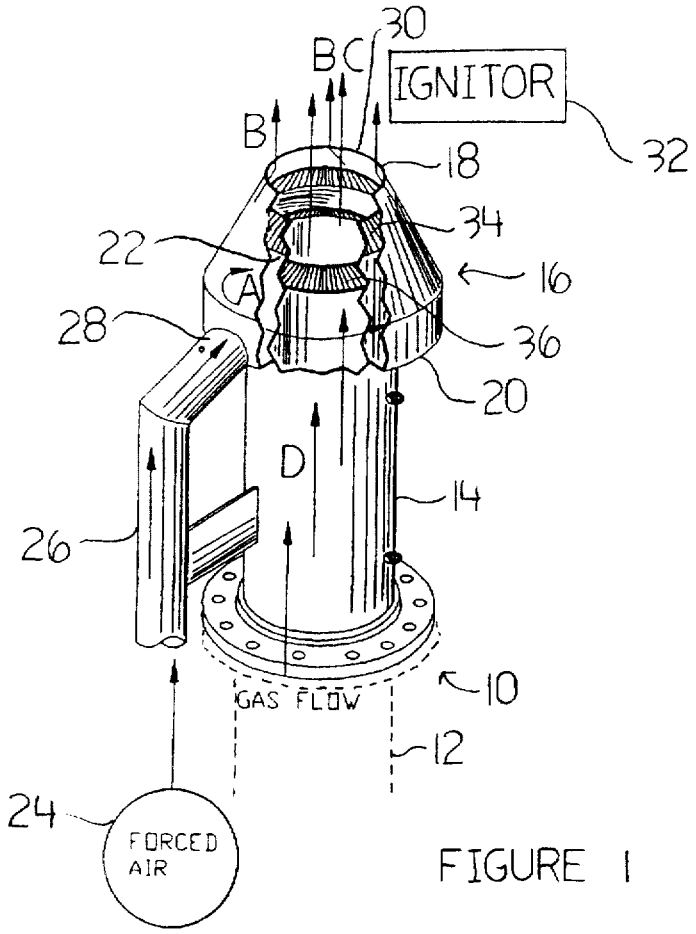
FIG. 1 is a perspective view, partly cut away, of a flare stack with conical shield according to the invention.
Figure 2:
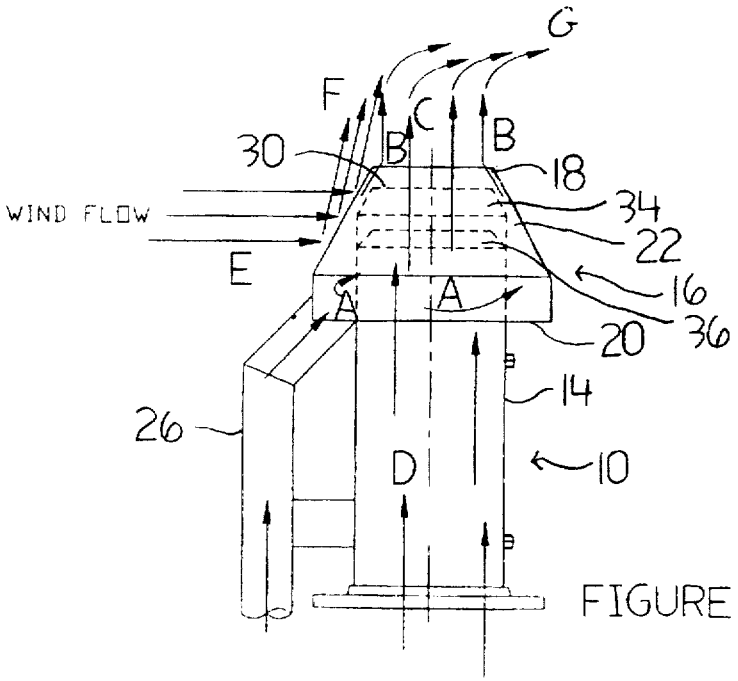
FIG. 2 is a side view, partly cut away, of a flare stack with conical shield according to the invention.

Referring to FIGS. 1 and 2, a flare stack 10 is formed of a pipe 12 terminating upward in use in a flare tip 14. A conical shield 16 having an apical end 18 and a base 20 is secured to and spaced from the flare tip 14 as shown at 22 to allow gas to flow between the conical shield 16 and the flare tip 14. The conical shield 16 is open at the apical end 18 adjacent the top edge 30 of the flare tip. The base 20 is welded or otherwise secured so as to be sealed to a portion of the flare tip below the top edge 30.

A source 24 of forced air or other suitable (cheap and readily available) gas supplies air through a conduit 26 connected between the source of forced air and an opening 28 in the base 20 and thus into the space 22 between the conical shield 16 and the flare tip 14. The air flows around the base as shown by arrows A and then flows out between the apical end 18 and the top edge 30 of the flare tip 14 as shown by arrows B. Having the space between the apical end 18 and the top edge 30 constricted in relation to the space between the conical shield 16 and the flare tip 14 at the base of the conical shield facilitates a flow of air around the flare tip and increases the velocity of the air as it exits the conical shield, thus forcing the flame higher.

The open ended pipe 12 functions as a main gas rise that carries the purge gas up to the flare tip. An ignitor 32 of conventional design is supported on the flare stack 10 by conventional means. Flow of air from the source of forced air (a blower) and through the space 22 is provided preferably such that the flow of air at B has a greater velocity than the flow of gas C from the flare stack. To enhance flow velocity of the gas in the flare tip, inclined venturi surfaces 34 and 36 protruding into the gas stream in the flare tip 14 may be provided near the top of the flare tip. Hence, the gas at C has a greater velocity than the gas at D in the pipe 12.

The conical shield 16 also deflects cross winds indicated by arrows E up and over the flare tip as indicated at G. Enhanced velocity of the gas and air from the flare tip 14 as provided by the air flow B and the gas flow C ensures that the burn is lifted above the flare tip, thus assisting in keeping the burn on, and assisting in preventing premature wear of the flare tip due to heating of the flare tip by the burn.

The apical angle of the conical shield is preferably about 60°, but may be from at least as low as 40° up to at least 80°, the upper end being limited by the consideration that the shield should not block the flow of gas.

A person skilled in the art could make immaterial modifications to the invention described in this patent document without departing from the essence of the invention that is intended to be covered by the scope of the claims that follow.

The embodiments of the invention in which an exclusive property or privilege is claimed are defined as follows:

1. A flare stack, comprising:

a pipe having a flare tip;

a conical shield having an apical end and a base, and being secured to and spaced from the flare tip to allow gas to flow between the conical shield and the flare tip, the conical shield being open at the apical end;

the conical shield being sealed around the flare tip at the base of the conical shield, and means connected to the conical shield for providing a flow of gas between the conical shield and the flare tip.

2. The flare stack of claim 1 in which the means to provide a flow of gas comprises:

a blower; and a conduit connected between the blower and the conical shield.

3. The flare stack of claim 1 in which the flare stack has at least one velocity arrestor inside the pipe for increasing velocity of flare gases exitting the flare stack.

4. The flare stack of claim 2 in which the blower provides air to the conical shield.

5. The flare stack of claim 2 in which the conduit is connected to the base of the conical shield.

* * * * *

UNITED STATES PATENT AND TRADEMARK OFFICE

CERTIFICATE OF CORRECTION

PATENT NO. : 5,749,719

DATED : May 12, 1998

INVENTOR(S) : Robert Karl Rajewski

It is certified that error appears in the above-indentified patent and that said Letters Patent is hereby corrected as shown below:

Column 4, line 1, "to provide" is amended to read --for providing--

Signed and Sealed this

First Day of December, 1998

*Attest:*

*Attesting Officer*

BRUCE LEHMAN

*Commissioner of Patents and Trademarks*